US011401790B2

(12) United States Patent
Fripp et al.

(10) Patent No.: US 11,401,790 B2
(45) Date of Patent: Aug. 2, 2022

(54) COMPLETION SYSTEMS, METHODS TO PRODUCE DIFFERENTIAL FLOW RATE THROUGH A PORT DURING DIFFERENT WELL OPERATIONS, AND METHODS TO REDUCE PROPPANT FLOW BACK

(71) Applicant: Halliburton Energy Services, Inc., Houston, TX (US)

(72) Inventors: Michael Linley Fripp, Carrollton, TX (US); Richard Decena Ornelaz, Frisco, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 78 days.

(21) Appl. No.: 16/984,493

(22) Filed: Aug. 4, 2020

(65) Prior Publication Data

US 2022/0042402 A1 Feb. 10, 2022

(51) Int. Cl.
*E21B 34/14* (2006.01)
*E21B 43/08* (2006.01)
(Continued)

(52) U.S. Cl.
CPC ..... *E21B 43/14* (2013.01); *E21B 34/142* (2020.05); *E21B 43/12* (2013.01); *E21B 43/267* (2013.01); *E21B 43/08* (2013.01)

(58) Field of Classification Search
CPC ..... E21B 34/14; E21B 34/142; E21B 43/08; E21B 43/12; E21B 43/14; E21B 43/267
See application file for complete search history.

(56) References Cited

U.S. PATENT DOCUMENTS 7,604,055 B2 * 10/2009 Richard ..... E21B 43/08 166/308.1
7,802,627 B2 9/2010 Hofman et al.
(Continued)

FOREIGN PATENT DOCUMENTS

CA 2800058 A1 6/2014
EP 2038512 10/2011
(Continued)

OTHER PUBLICATIONS

International Search Report and Written Opinion issued in corresponding International PCT Patent Application No. PCT/US2020/045795; dated Apr. 15, 2021.
(Continued)

*Primary Examiner* — Matthew R Buck
(74) *Attorney, Agent, or Firm* — McGuireWoods LLP

(57) ABSTRACT

Completion systems, methods to produce differential flow rate through a port during different well operations, and methods to reduce proppant flow back are disclosed. A completion system includes a tubular extending through a wellbore and having a first port and a second port. The completion system also includes a cover disposed along an interior of the tubular and configured to cover the first port and the second port while the cover is in a first position and is configured to uncover the first port and the second port while the cover is in a second position. The completion system further includes a valve disposed along the tubular and configured to differentially restrict fluid flow through the first port during different well operations.

20 Claims, 8 Drawing Sheets

(51) Int. Cl.

| | |
|---|---|
| ***E21B 43/12*** | (2006.01) |
| ***E21B 43/267*** | (2006.01) |
| ***E21B 43/14*** | (2006.01) |

(56) References Cited

U.S. PATENT DOCUMENTS

| | | | | |
|---|---|---|---|---|
| 8,540,019 | B2 | 9/2013 | Hofman et al. | |
| 8,978,773 | B2 * | 3/2015 | Tilley | E21B 23/04 166/351 |
| 9,562,409 | B2 | 2/2017 | Xu | |
| 10,508,526 | B2 | 12/2019 | Ring et al. | |
| 2010/0314106 | A1 | 12/2010 | Tubel | |
| 2011/0284232 | A1 * | 11/2011 | Huang | E21B 34/06 166/317 |
| 2012/0085548 | A1 | 4/2012 | Fleckenstein et al. | |
| 2015/0122493 | A1 | 5/2015 | Wood et al. | |
| 2016/0108711 | A1 | 4/2016 | Lynk | |
| 2016/0312579 | A1 * | 10/2016 | Green | E21B 47/14 |
| 2018/0094508 | A1 * | 4/2018 | Smith | E21B 43/26 |

FOREIGN PATENT DOCUMENTS

| | | | | |
|---|---|---|---|---|
| WO | 2015110463 | | 7/2015 | |
| WO | 2017173554 | A1 | 10/2017 | |
| WO | WO-2021119852 | A1 * | 6/2021 | E21B 43/12 |

OTHER PUBLICATIONS

Schlumberger Limited. Filter Cartridges—Protection for polishing and absolute-rating filters. https://www.slb.com/completions/fluids-and-tools/filtration/filter-cartridges.

* cited by examiner

COMPLETION SYSTEMS, METHODS TO PRODUCE DIFFERENTIAL FLOW RATE THROUGH A PORT DURING DIFFERENT WELL OPERATIONS, AND METHODS TO REDUCE PROPPANT FLOW BACK

The present disclosure relates generally to completion systems, methods to produce differential flow rate through a port during different well operations, and methods to reduce proppant flow back.

Fluids are sometimes pumped through one or more ports of a tubular into a wellbore during certain well operations, such as hydraulic fracturing operations and well injection operations. For example, during certain hydraulic fracturing operations, fluids containing water and proppant are pumped through one or more ports of the tubular into the wellbore to create cracks in the deep-rock formations through which hydrocarbon resources such as natural gas, petroleum, and brine will flow more freely. The hydrocarbon resources subsequently flow from the formation into the tubular, where the hydrocarbon resources eventually flow to the surface.

BRIEF DESCRIPTION OF THE DRAWINGS

Illustrative embodiments of the present disclosure are described in detail below with reference to the attached drawing figures, which are incorporated by reference herein, and wherein.

Figure 1:
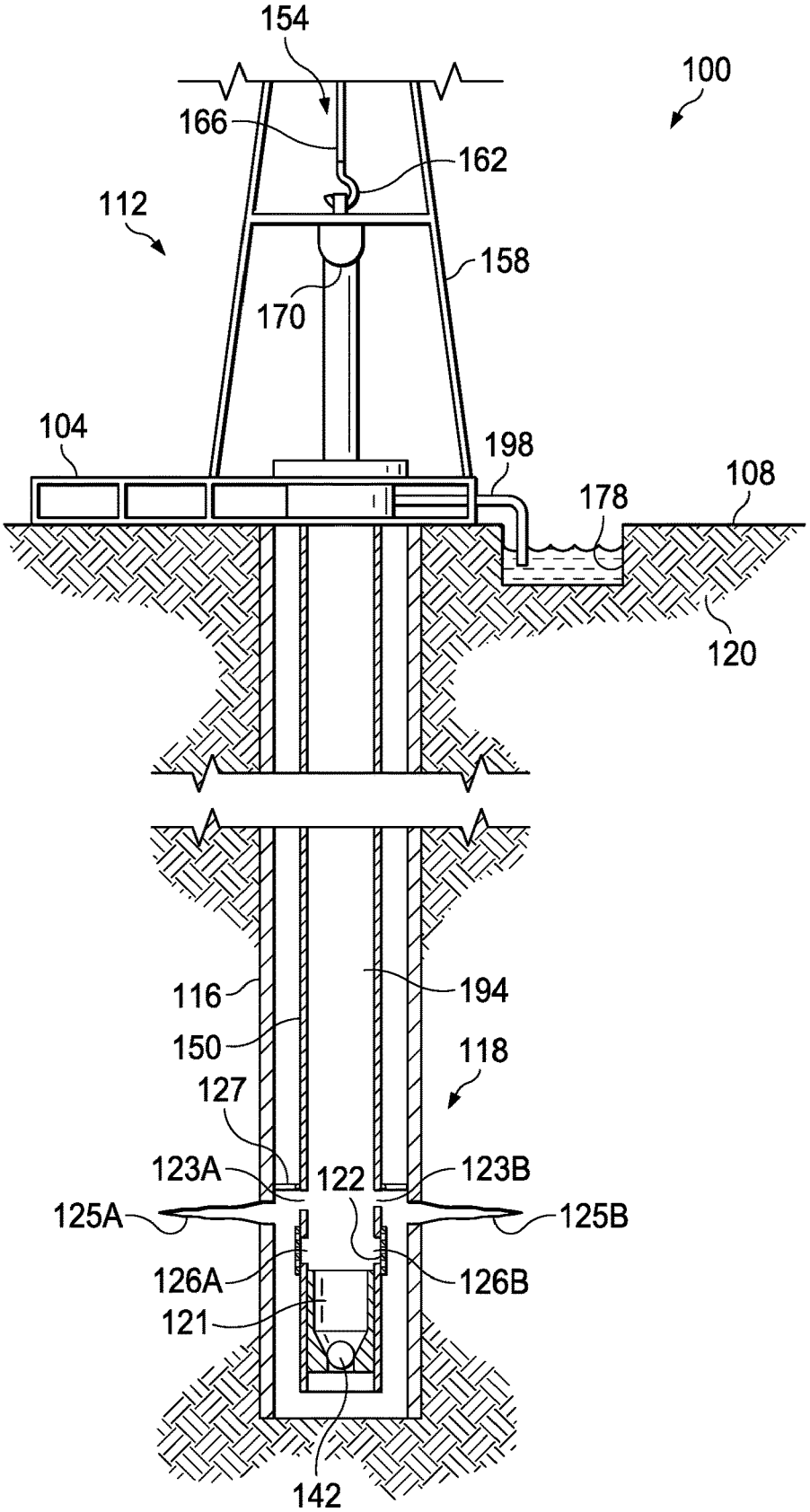
FIG. 1 is a schematic, side view of a completion environment in which a completion system is deployed in a wellbore.

The illustrated figures are only exemplary and are not intended to assert or imply any limitation with regard to the environment, architecture, design, or process in which different embodiments may be implemented.

DETAILED DESCRIPTION

In the following detailed description of the illustrative embodiments, reference is made to the accompanying drawings that form a part hereof. These embodiments are described in sufficient detail to enable those skilled in the art to practice the invention, and it is understood that other embodiments may be utilized and that logical structural, mechanical, electrical, and chemical changes may be made without departing from the spirit or scope of the invention. To avoid detail not necessary to enable those skilled in the art to practice the embodiments described herein, the description may omit certain information known to those skilled in the art. The following detailed description is, therefore, not to be taken in a limiting sense, and the scope of the illustrative embodiments is defined only by the appended claims.

The present disclosure relates to completion systems, methods to produce differential flow rate through a port during different well operations, and methods to reduce proppant flow back. A completion system includes a tubular that extends through a wellbore of a hydrocarbon well. As referred to herein, a tubular includes casings, oilfield tubulars, production tubing, drill pipes, coiled tubing, and any other type of conveyance having an inner diameter that forms a flowbore for fluids to pass through. The tubular also has at least two ports (e.g., production ports, fracture ports, as well as other types of openings) that provide fluid passageways from the tubular to the surrounding formation and from the surrounding formation into the tubular.

The completion system also includes a cover that is disposed along an interior of the tubular and is configured to cover the ports while the cover is in a first position. As referred to herein, a cover is any device or component configured to prevent or restrict fluid communication through a port or an opening. In some embodiments, a cover is shiftable from a first position, which prevents fluid communication through one or more ports, to a second position to allow fluid communication through the ports. In some embodiments, the cover is a sleeve that is configured to prevent fluid communication through one or more ports while in one position, and is configured to allow fluid communication through the ports while in a second position. A cover includes a hollow interior and a diverter seat that is formed in or is disposed in the hollow interior. As referred to herein, a diverter seat is any device configured to catch or retain a diverter, whereas a diverter is any device configured to engage the diverter seat to shift the cover. Examples of diverter seats include, but are not limited to, ball seats, dart seats, plug seats, and baffles, whereas examples of diverters include, but are not limited to, balls, darts, and plugs that are deployable in the flowbore. In some embodiments, the diverter seat is formed by a tapered profile of the hollow interior, which allows the diverter to flow into one opening of the cover, but prevents the diverter from flowing out of a second opening of the cover. In some embodiments, the diverter seat is electronically, hydraulically, mechanically, or electromagnetically actuated to catch the diverter before the diverter lands on the diverter seat.

In some embodiments, where a diverter (such as a ball) is dropped into the flowbore of the tubular, the ball flows downhole until the ball lands on the diverter seat of the cover. Force generated by the ball landing on the diverter seat shifts the cover from a first position to a second position to expose one or more ports previously covered by cover. In some embodiments, the cover is configured to receive a signal (such as electrical signal, acoustic signal, electromagnetic signal, or optical signal, or other type of signal), and is configured to shift from the first position to the second position in response to receiving the signal.

The completion system also includes a valve that is disposed along the tubular. Examples of valves include, but are not limited to, flapper valves, ball valves, check valves, one way valves, diaphragm check valves, stop-check valves, lift-check valves, in-line check valves, and other types of valves that are configured to differentially restrict fluid flow. The valve is positioned proximate to a port (first port) and configured to differentially restrict fluid flow through the first port during different downhole operations. In one or more of such embodiments, the valve is initially configured to be in a closed position while the cover is in the first position. The valve is further configured to shift from the closed position to an open position after the cover shifts to a second position to open the first port during certain well operations, such as during a fracturing operation to permit fracturing through the first port and injection of proppant into the surrounding formation. The valve is further configured to shift from the open position to the closed position after completion of the fracturing operation or another well operation that utilizes the first port. In some embodiments, the valve is mounted to the tubular with a hinge or a fixture. In some embodiments, after the valve is mounted to the tubular, the valve is subsequently unmounted from the tubular with a moveable plate, a ball check, or another apparatus configured to unmount the valve.

In some embodiments, a screen is attached to or forms a section of the valve to permit fluid flow through the valve even when the valve is in a closed position, and restrict particles greater than a threshold size from flowing into the first port while the valve is in the closed position. As referred to herein, a screen is any device, structure, material, or component that prevents materials greater than a threshold size from flowing through the screen. Examples of screens include, but are not limited to, surface filters such as wire wrap screen assemblies or woven meshes, depth filters like metal wools, and layered fibers. In some embodiments, a screen is a porous structure such as bonded together proppants. In some embodiments, a screen is formed from wires wrapped around a pipe with a gap between the wires, a metal mesh protected by a perforated covering, or a combination of layers of wire wrap, mesh and protective layers. In some embodiments, an erosion resistant insert is disposed along a wall of the first port to reduce or prevent erosion of the wall of the tubular around the first port. In one or more of such embodiments, the erosion resistant material is a ceramic. In one or more of such embodiments, the erosion resistant material is formed from rubber.

In some embodiments, the completion system also includes a screen that is disposed around a second port that provides fluid communication through the tubular. Moreover, the screen is configured to restrict or limit solid particles greater than a threshold size from flowing into the second port. In some embodiments, a fluid restrictor, such as an inflow control device (ICD), an autonomous inflow control device (AICD), an adjustable ICD, an inflow control valve (ICV), an autonomous inflow control valve (AICV), or another type of device that is configured to restrict fluid flow is fluidly coupled to the screen to limit or restrict fluid flow through the second port. Additional descriptions of the completion system, methods to produce differential flow rate though ports of the completion system, and methods to reduce proppant flow back are provided in the paragraphs below and are illustrated in FIGS. 1-5.

Turning now to the figures, FIG. 1 is a schematic, side view of a completion environment 100 where a completion system 118 having a tubular 150, a cover 121 and a valve 127 is deployed in a wellbore 116 of a well 112. As shown in FIG. 1, wellbore 116 extends from surface 108 of well 112 to a subterranean substrate or formation 120. Well 112 and rig 104 are illustrated onshore in FIG. 1. Alternatively, the operations described herein and illustrated in the figures are performed in an off-shore environment. In the embodiment illustrated in FIG. 1, wellbore 116 has been formed by a drilling process in which dirt, rock and other subterranean materials are removed to create wellbore 116. In some embodiments, a portion of wellbore 116 is cased with a casing. In other embodiments, wellbore 116 is maintained in an open-hole configuration without casing. The embodiments described herein are applicable to either cased or open-hole configurations of wellbore 116, or a combination of cased and open-hole configurations in a particular wellbore.

After drilling of wellbore 116 is complete and the associated drill bit and drill string are "tripped" from wellbore 116, tubular 150 is lowered into wellbore 116. In the embodiment of FIG. 1, tubular 150 is lowered by a lift assembly 154 associated with a derrick 158 positioned on or adjacent to rig 104 as shown in FIG. 1. Lift assembly 154 includes a hook 162, a cable 166, a traveling block (not shown), and a hoist (not shown) that cooperatively work together to lift or lower a swivel 170 that is coupled to an upper end of tubular 150. In some embodiments, tubular 150 is raised or lowered as needed to add additional sections to tubular 150 and to run tubular 150 across a desired number of zones of wellbore 116.

In the embodiment of FIG. 1, tubular 150 includes a flowbore 194 that provides a passageway for fluids and solid particles to flow downhole. As referred to herein, downhole refers to a direction along tubular 150 that is away from the surface end of tubular 150, whereas uphole refers to a direction along tubular 150 that is towards the surface end of tubular 150. In some embodiments, flowbore 194 also provides a fluid passageway for a fluid to flow uphole, where the fluid eventually flows into an outlet conduit 198, and from outlet conduit 198 into a container 178. In some embodiments, tubular 150 also provides a fluid flow path for fluids to flow into one or more cross-over ports (not shown) that provide fluid flow around (such as up and/or below) completion system 118. In one or more of such embodiments, hydraulic pressure is exerted through a cross-over port to shift cover 121 (such as to shift cover 121 downhole) and/or to perform other well operations. In some embodiments, one or more pumps (not shown) are utilized to facilitate fluid flow downhole or uphole, and to generate pressure downhole or uphole.

In the embodiment of FIG. 1, hydraulic pressure applied to cover 121 and/or force generated by landing of a ball 142 on cover 121 has shifted cover 121 downhole to uncover ports 123A, 123B, 126A, and 126B. Additional descriptions of shifting cover 121 to uncover ports are provided herein and are illustrated in at least FIGS. 2A-2C. In the embodiment of FIG. 1, valve 127 is a flapper valve that is in an open position. In some embodiments, valve 127 is mounted to tubular 150 with a hinge or a fixture (not shown). In some embodiments, after valve 127 is mounted to tubular 150, valve 150 is configured to be unmounted from tubular 150 with a moveable plate, a ball check, or another apparatus configured to unmount the valve (not shown). While valve 127 is in an open position, fluids, such as fluids carrying proppant, flow from flowbore 194 out of ports 123A and 123B, and into fractures 125A and 125B of formation 120. In some embodiments, a well operation, such as a hydraulic fracturing operation, is performed through ports 123A and 123B while valve 127 is in an open position.

Completion system 118 also has a screen 122 positioned around ports 126A and 126B. During certain operations where cover 121 is in the second position and valve 127 is an open position as illustrated in FIG. 1, ports 123A, 123B, 126A, and 126B provide fluid flow paths for fluids to flow into and out of tubular 150. However, screen 122 is configured to filter particles greater than a threshold size from flowing through ports 126A and 126B. In some embodiments, valve 127 is configured to shift from the open position illustrated in FIG. 1 to a closed position (such as illustrated in FIG. 2C) to cover ports 123A and 123B before commencement of certain well operations, such as production operations. In one or more of such embodiments, only ports 126A and 126B remain open after valve 127 shifts to a closed position. Further, screen 122 prevents solid particles, such as proppant, from flowing from fractures 125A and 125B back into flowbore 194 during a production operation, or another operation after valve 127 has shifted to a closed position.

Although FIG. 1 illustrates ports 123A, 123B, 126A, and 126B, in some embodiments, completion system 118 has a different number of ports (not shown) that provide fluid communication through tubular 150. In some embodiments, tubular 150 only has ports 123A and 126A. Further, although FIG. 1 illustrates one cover 121, one valve 127, and one screen 122, in some embodiments, completion system 118 includes multiple covers (not shown), multiple screens (not shown), and multiple valves (not shown) disposed across multiple zones of wellbore 116. Further, although valve 127 of FIG. 1 is configured to cover ports 123A and 123B, in some embodiments, valve 127 is configured to cover a single port (such as 123A), or a different number ports disposed along tubular 150. Similarly, although screen 122 is positioned around two ports 126A and 126B, in some embodiments, screen 122 is positioned around a single port (such as port 126A) or is positioned around a different number of ports to restrict particles greater than a threshold size from flowing into the ports.

Although FIG. 1 illustrates a substantially vertical wellbore 116, the completion systems described herein are deployable in horizontal wellbores, diagonal wellbores, tortuous shaped wellbores, and other types of wellbores. Further, although FIG. 1 illustrates a completion system deployed in a completion environment, completion system 118 also deployable in other well environments. Similarly, operations described herein may be performed during stimulation operations, production operations, as well as other types of well operations. Additional description of different embodiments of the completion system are provided herein and are illustrated in FIGS. 2A-2C and 3A-3C.

Figure 2A:
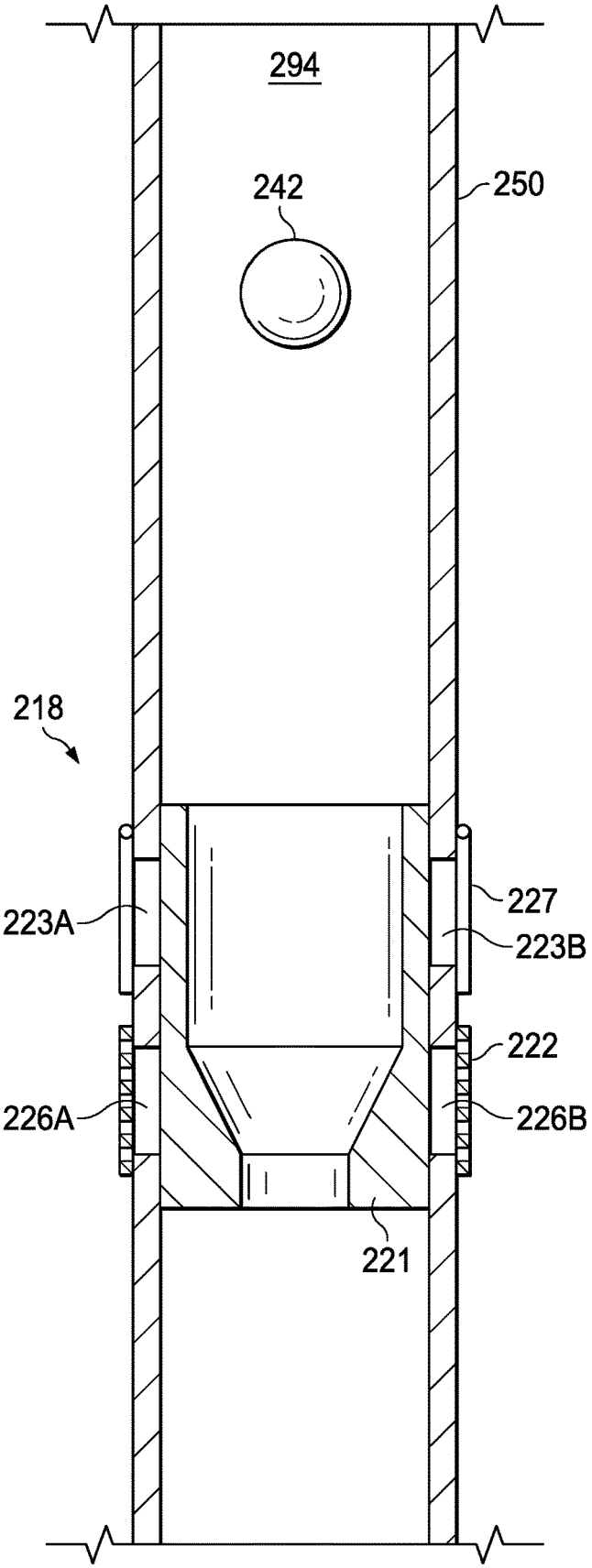
FIG. 2A is a schematic, cross-sectional view of a completion system that is deployable in the wellbore of FIG. 1, where a cover disposed in the interior of a tubular is in a first position that covers multiple ports of the tubular.

FIG. 2A is a schematic, cross-sectional view of a completion system 218 that is deployable in wellbore 116 of FIG. 1, where a cover 221 disposed in the interior of a tubular 250 is in a first position that covers multiple ports 223A, 223B (first set of ports), 226A, and 226B (second set of ports) of tubular 250. More particularly, cover 221 prevents fluid flow from tubular 250 into ports 223A, 223B, 226A, and 226B while cover 221 is in the first position. Additional configurations of cover 221 are provided in the paragraphs below and are illustrated in at least FIGS. 2B and 2C. Completion system 218 also includes a valve 227 that is disposed along the exterior of tubular 250. In the embodiment of FIG. 2A, valve 227 is in a closed position to prevent or reduce fluid flow from the wellbore or the formation into first set of ports 223A and 223B. Completion system 218 also includes a screen 222 that is positioned around second set of ports 226A and 226B, where screen 222 is configured to prevent solid particles greater than a threshold size from flowing through screen 222 and into second set of ports 226A and 226B.

Figure 2B:
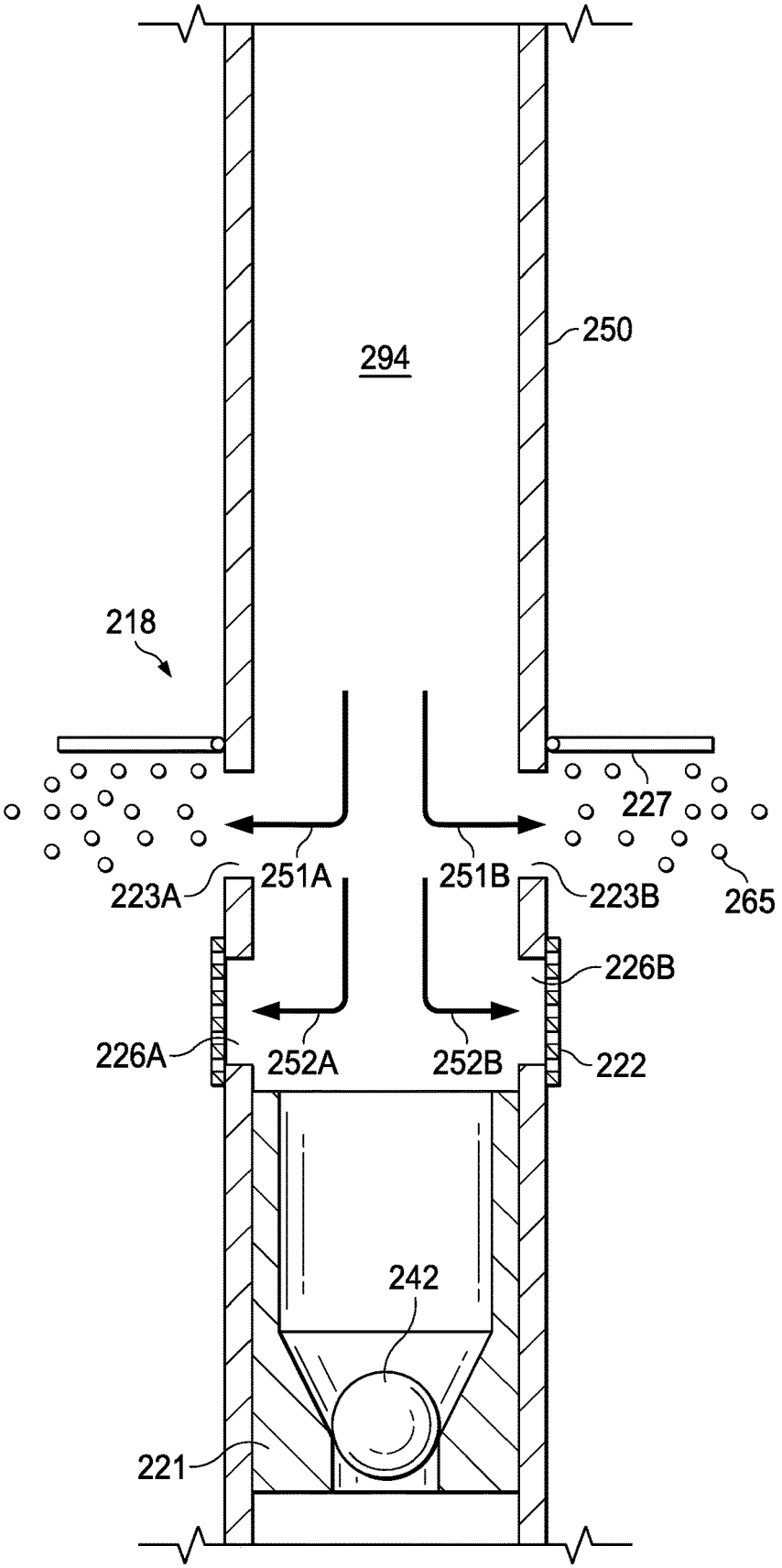
FIG. 2B is a schematic, cross-sectional view of the completion system of FIG. 2A after the cover shifts from the position illustrated in FIG. 2A to a second position to uncover the ports.
Figure 2C:
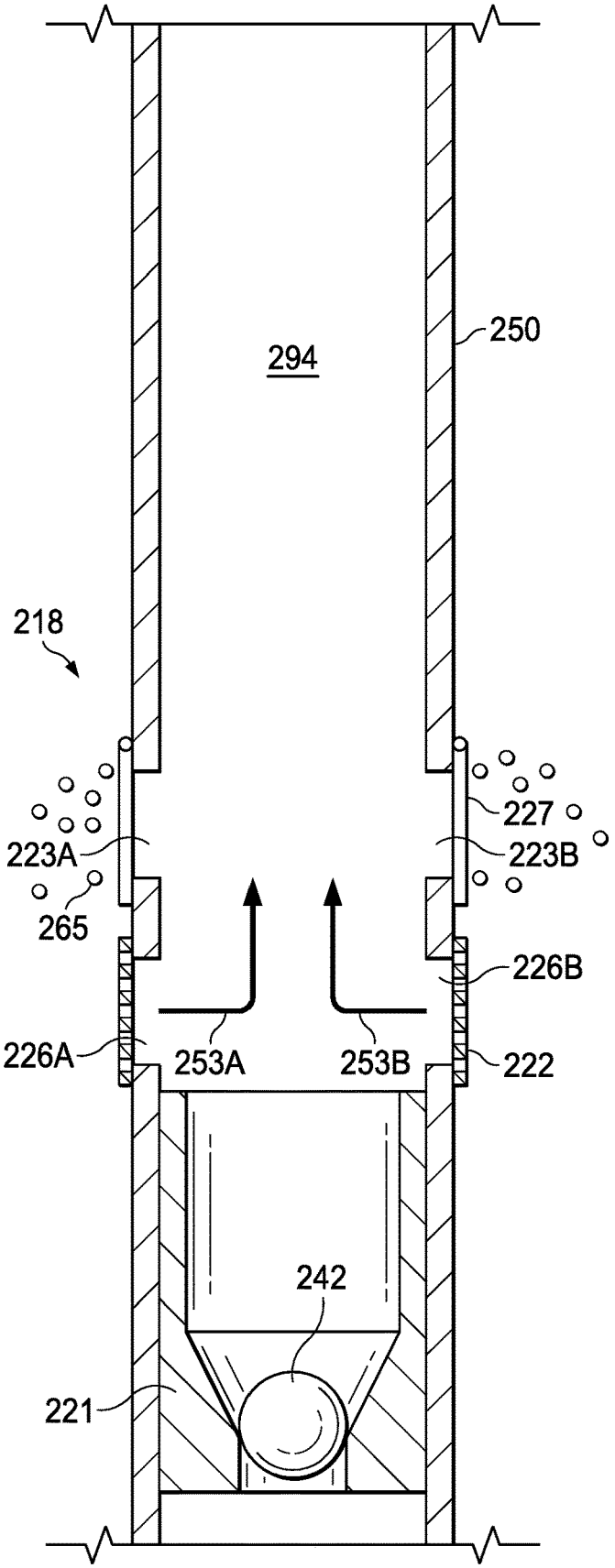
FIG. 2C is a schematic, cross-sectional view of the completion system of FIG. 2B after a valve shifts from an open position illustrated in FIG. 2B to a closed position.

A diverter such as ball 242 is dropped in tubular 250, where ball 242 flows in flowbore 294 downhole until ball 242 lands on cover 221 or diverter seat of cover 221. Moreover, force generated by ball 242 landing on cover 221 or the diverter seat shifts cover 221 from a first position illustrated in FIG. 2A to a second position illustrated in FIG. 2B to uncover ports 223A, 223B, 226A, and 226B, which were previously covered by cover 221 while cover was in the first position as shown in FIG. 2A. In that regard, FIG. 2B is a schematic, cross-sectional view of completion system 218 of FIG. 2A after cover 221 shifts from the first position illustrated in FIG. 2A to a second position to uncover first set of ports 223A and 223B and second set of ports 226A and 226B. Valve 227 has shifted from the closed position illustrated in FIG. 2A to the open position illustrated in FIG. 2B. The shifting of valve 227 from the closed position to the open position and the shifting of cover 221 permits fluids flowing in flowbore 294 of tubular 250 to flow through first set of ports 223A and 223B into the surrounding wellbore and formation. In the embodiment of FIG. 2B, solid particles, such as proppant 265, are pumped through tubular 250, where the solid particles flow out of first set of ports 223A and 223B in directions illustrated by arrows 251A and 251B into the surrounding wellbore and formation, such as into fractures 125A and 125B of FIG. 1, to form additional fractures and to enhance existing fractures. In the embodiment of FIG. 2B, fluids flowing through tubular 250 also flow out of second set of ports 226A and 226B in directions illustrated by arrows 252A and 252B to increase the rate of fluid flow during operations where first set of ports 223A and 223B and second set of ports 226A and 226B are uncovered. However screen 222 prevents particles (such as proppant) having greater than a threshold size from flowing out of second set of ports 226A and 226B into the surrounding wellbore and formation.

The first set of ports 223A and 223B are subsequently covered after completion of operations (such as fracturing and injection operations) that utilize first set of ports 223A and 223B. In that regard, FIG. 2C is a schematic, cross-sectional view of completion system 218 of FIG. 2B after valve 227 shifts from the open position illustrated in FIG. 2B to a closed position illustrated in FIG. 2C. In the embodiment of FIG. 2C, the shifting of valve 227 to the closed position prevents fluids and particles, such as proppant 265, from flowing through first set of ports 223A and 223B into flowbore 294 of tubular 250. Second set of ports 236A and 236B remain open, thereby permitting fluids, such as hydrocarbon resources, to flow from the formation into tubular 250 via seconds set of ports 226A and 226B. In the embodiment of FIG. 2C, fluids such as hydrocarbon resources flow through screen 222 into second set of ports 226A and 226B in directions illustrated by arrows 253A and 253B. However, solid particles such as proppant and other particles that are greater than a threshold size are prevented from flowing back into tubular 250 by screen 222 and by valve 227, thereby reducing proppant flow back during production operations or other well operations performed after valve 227 shifts to the closed position.

In the embodiment of FIGS. 2B-2C, the shifting of valve 227 from the open position to the closed position also reduces the flow rate of fluids flowing through first set of ports 223A and 223B and second set of ports 226A and 226B. In that regard, valve 222 is also configured to shift from the open position to the closed position to adjust the flow rate through first set of ports 223A and 223B and second set of ports 226A and 226B.

Although FIGS. 2A-2C illustrate first set of ports 223A and 223B and second set of ports 226A and 226B each having two ports, in some embodiments each of first and second set of ports only has one port (such as 223A and 223B), or a different number of ports. Further, although FIGS. 2A-2C illustrate ball 242 landing on cover 221 to shift cover 221 downhole, in some embodiments, cover 221 is configured to receive a signal (such as electrical signal, acoustic signal, electromagnetic signal, or optical signal, or other type of signal), and is configured to shift from the first position to the second position in response to receiving the signal. In some embodiments, cover 221 is electrically or hydraulically activated to shift from the first position to the second position. In some embodiments, cover 221 shifts in an uphole direction to uncover first set of ports 223A and 223B and second set of ports 226A and 226B. In some embodiments, where the diverter (such as ball 242) is dissolvable, degradable, or melts after a period of time, cover 221 remains in the second position illustrated in FIGS. 2B and 2C. In some embodiments, cover 221 subsequently shifts from the second position illustrated in FIGS. 2B and 2C back to the first position or to another position to cover one or more of first set of ports 223A and 223B and second set of ports 226A and 226B. In some embodiments, a fluid restrictor, such as an ICD, an AICD, an ICV, an AICV, an adjustable ICD, or another type of device that is configured to restrict fluid flow is fluidly coupled to screen 222 to limit or restrict fluid flow through second set of ports 226A and 226B. Although valve 227 is disposed on the exterior of tubular 250, in some embodiments, valve is also disposed on the interior of tubular. In one or more of such embodiments, cover 221 also covers valve 227 while cover 227 is in the first position illustrated in FIG. 2A and uncovers valve 227 after cover 227 shifts to the second position illustrated in FIG. 2B. In some embodiments, fluids flow around edges of valve 227 into first set of ports 223A and 223B while valve 227 is in a closed position. However, valve 227 prevents solid particles, such as proppant and other particles greater than a threshold size from flowing into first set of ports 223A and 223B, thereby reducing proppant flow back while valve 227 is in the closed position.

Although completion 218 of FIGS. 2A-2C has one cover 221, one valve 227 and one screen 222, in some embodiments, completion system 218 has multiple covers (not shown), valves (not shown) and screens (not shown) that are disposed along tubular 250, and configured to produce differential flow rate through additional ports (not shown) of tubular 250, and to reduce proppant flow back through the ports. In one or more of such embodiments, some of the covers and valves disposed in one zone of the wellbore are configured to shift at times different from covers and valves that are disposed in other zones of the wellbore to individually control the flow rate and proppant flow back across different zones of the wellbore. In one or more of such embodiments, all of the covers and valves disposed across multiple zones of the wellbore are configured to shift in unison, thereby uniformly producing differential flow rate though the ports and reducing proppant flow back across each zone of the wellbore.

Figure 3A:
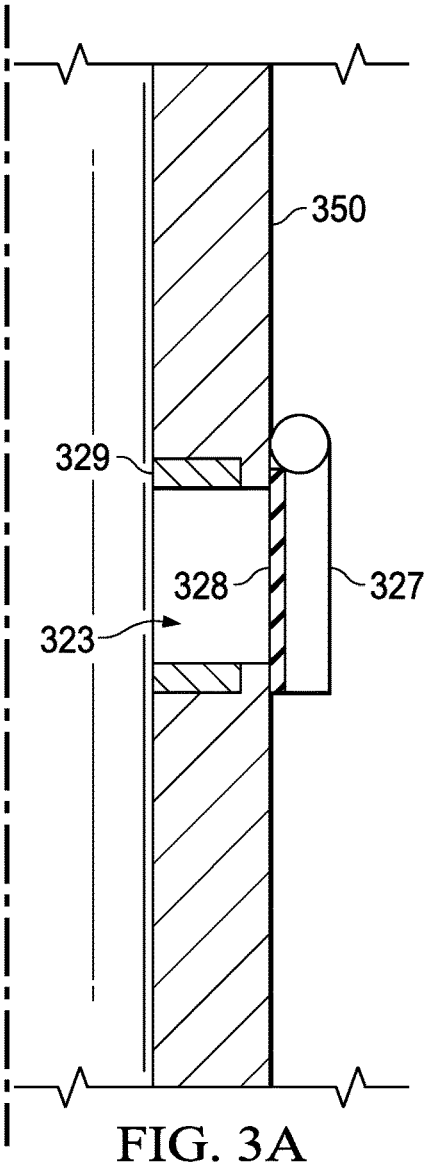
FIG. 3A illustrates a completion system that is similar to the completion system illustrated in FIGS. 2A-2C and having an erosion resistant insert.

In some embodiments, erosion and corrosion resistant materials are utilized to reduce erosion of completion system 218 of FIGS. 2A-2C and similar completion systems. In that regard, FIG. 3A illustrates a completion system that is similar to the completion system illustrated in FIGS. 2A-2C and having an erosion resistant insert 329 disposed along the walls of a port 323. Erosion resistant insert 329 is formed from a material that reduces or prevents erosion of port 323 during injection operations, fracturing operations, or other well operations that utilize port 323. Examples of erosion resistant materials include, but are not limited to, rubber, ceramic materials, as well as other types of materials that reduce or prevent erosion of port 323. Further, valve 327 is coated with a material 328 that reduces or prevents erosion of valve 327. Examples of material 328 include, but are not limited to, hardened metal, ceramic, an energy dampening material (such as elastomer, rubber, or shape memory metal) that is configured to absorb erosion, as well as other types of materials that are configured to reduce or prevent erosion of valve 327.

Figure 3B:
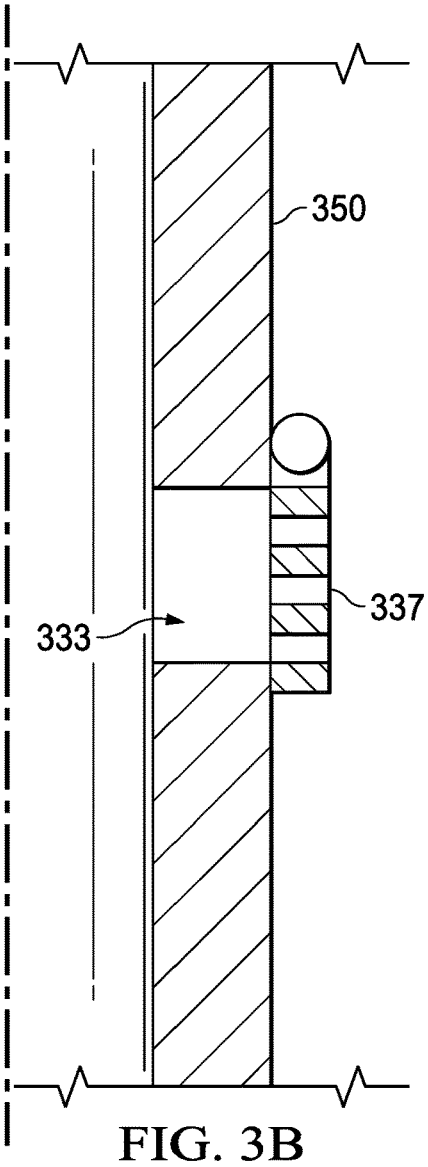
FIG. 3B illustrates another completion system that is similar to the completion system illustrated in FIGS. 2A-2C, and having a valve that is configured to permit fluids and solid particles smaller than or equal to a threshold size to flow through the valve.

FIG. 3B illustrates another completion system that is similar to the completion system illustrated in FIGS. 2A-2C, and having a valve 337 (flapper) that is configured to permit fluids and solid particles smaller than or equal to a threshold size to flow through valve 337. In the embodiment of FIG. 3B, a screen similar to screen 222 of FIGS. 2A-2B is attached to valve 337 to permit fluids to flow through valve 337 even when valve 337 is in a closed position as illustrated in FIG. 3B. However, solid particles such as proppant and other particles that are greater than the threshold size are prevented by the screen of valve 337 from flowing into port 333. In the embodiment of FIG. 3B, a cover (not shown), such as cover 221 of FIGS. 2A-2B is initially positioned in a first position to prevent fluid flow into port 333. The cover is subsequently shifted to a second position to uncover port 333 and valve 337 is shifted to an open position similar to FIG. 2B to permit fluid flow through port 337 at a first flow rate. Valve 337 is subsequently shifted back to a closed position to restrict solid particles greater than the threshold size from flowing from the surrounding wellbore or formation into port 333 while allowing fluids to flow into port 333 at a second flow rate that is less than the first flow rate.

Figure 3C:
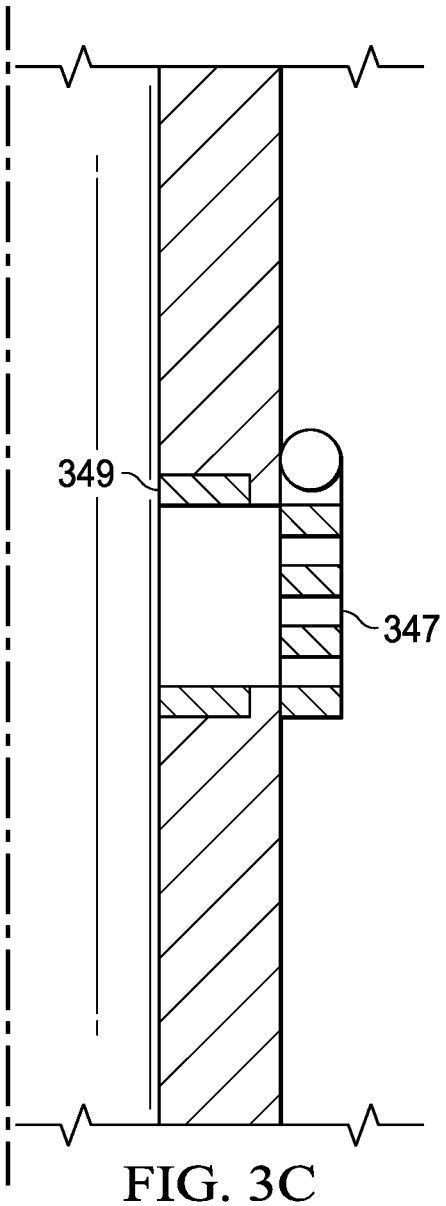
FIG. 3C illustrates another completion system that is similar to the completion system illustrated in FIG. 3B, and having an erosion resistant insert and a valve that is configured to permit fluids and solid particles smaller than or equal to a threshold size to flow through the valve.

FIG. 3C illustrates another completion system that is similar to the completion system illustrated in FIG. 3B, and having an erosion resistant insert 349 and a valve 347 that is configured to permit fluids and solid particles smaller than or equal to a threshold size to flow through valve 347. Valve 347 and insert 349 are similar to valve 337 of FIG. 3B and insert 329 of FIG. 3A, respectively, which are described herein. In the embodiment of FIGS. 3A-3C, valves 327, 337, and 347 are flapper valves. In some embodiments, different types of valves, such as ball valves, check valves, one way valves, diaphragm check valves, stop-check valves, lift-check valves, in-line check valves, and other types of valves that are configured to differentially restrict fluid flow and having screens and erosion resistant materials are utilized in lieu of valves 327, 337, and 347. Further, although ports 323 and 333 are illustrated in FIGS. 3A and 3B to extend perpendicular to an axis of tubular 350, in some embodiments, ports 323 and 333 are disposed at an acute angle relative to the axis of tubular 350 to reduce erosion of ports 323 and 333. In some embodiments, erosion resistant inserts 329 and 349 are also formed from a corrosion resistant material.

Figure 4:
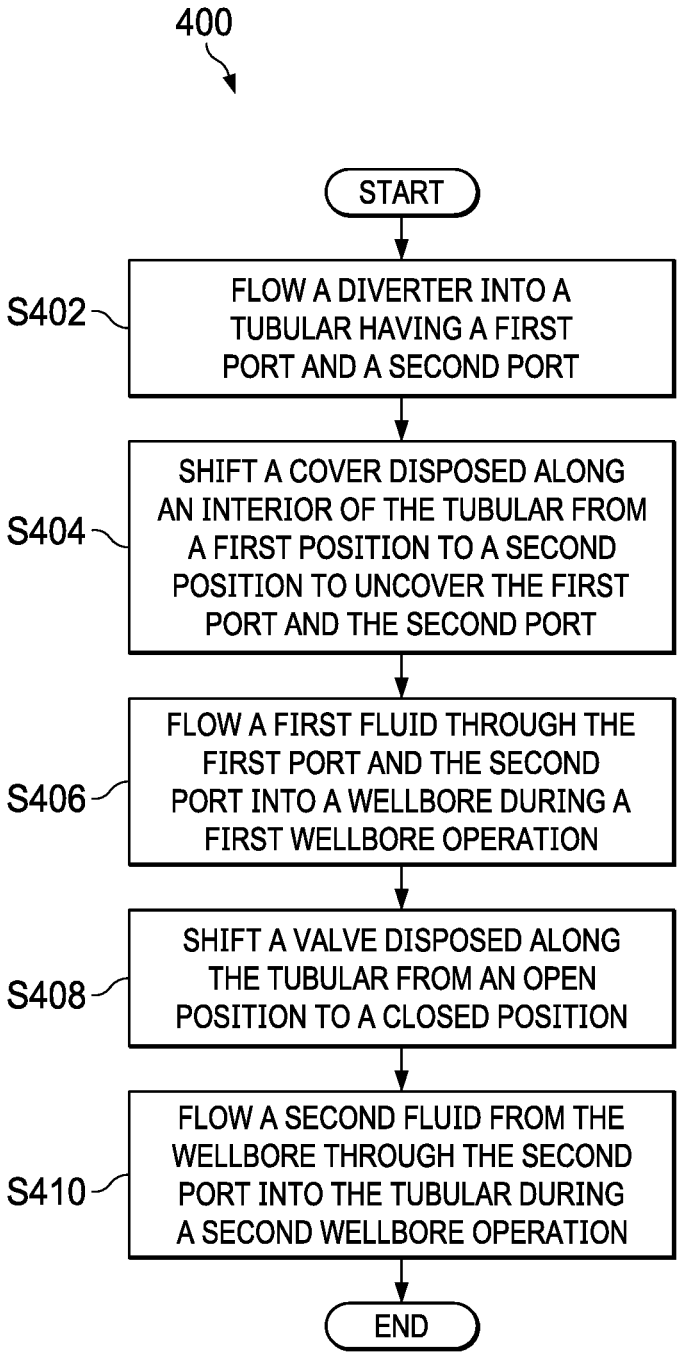
FIG. 4 is a flow chart of a process to produce differential flow rate through a port during different well operations.

FIG. 4 is a flow chart of a process 400 to produce differential flow rate through a port during different wellbore operations. Although the operations in the process 400 are shown in a particular sequence, certain operations may be performed in different sequences or at the same time where feasible.

At block S402, a diverter flows into a tubular having a first port and a second port. FIG. 2A, for example, illustrates flowing ball 242 down tubular 250 towards cover 221. At block S404, a cover that is disposed along an interior of the tubular is shifted from a first position to a second position to uncover the first port and the second port. FIGS. 2A-2B, for example, illustrate shifting cover 221 from a first position illustrated in FIG. 2A to a second position illustrated in FIG. 2B to uncover ports 223A and 226A. In the embodiment of FIGS. 2A-2B, force of ball 242 landing on a diverter seat of cover 221 shifts cover 221 from the position illustrated in FIG. 2A to the position illustrated in FIG. 2B to uncover ports 223A and 226A. In some embodiments, cover 221 is electronically, acoustically, optically, or electromagnetically activated. In some embodiments, cover 221 shifts to the second position before commencement of certain well operations, such as injection operations, fracturing operations, or other well operations that utilize ports initially covered by the cover 221.

At block S406, a first fluid flows through the first port and the second port into a wellbore during a first wellbore operation. In the embodiment of FIG. 2B, a fracturing fluid containing proppant 265 flows in the direction indicated by arrow 251A out of port 223A. In the embodiment of FIG. 2B, the fracturing fluid also flows in a direction indicated by arrow 252B out of port 226A. however, screen 222 prevents proppant and other solid particles greater than a threshold size from flowing out of port 226A. At block S408, a valve disposed along the tubular is shifted from an open position to a closed position. FIGS. 2B-2C, for example, illustrate shifting valve 227 from an open position illustrated in FIG. 2B to a closed position illustrated in FIG. 2C. In some embodiments, the valve shifts from the open position to the closed position after completion of certain well operations (such as fracturing, injection, or other operations) that utilize the first port, such as port 223A of FIGS. 2B-2C. In some embodiments, the valve shifts from the open position to the closed position before commencement of certain well operations (such as production operations) that utilize different ports. In one or more of such embodiments, valve 227 shift to the closed position to cover certain ports and to avoid proppant flow back through the covered ports during subsequent operations that do not utilize the covered ports.

At block S410, and after the valve shifts to the closed position, a second fluid flows from the wellbore through the second port into the tubular during a second wellbore operation. In the embodiment of FIG. 2C, hydrocarbon resources, such as oil and natural gas, flow from the surrounding formation through port 226A into tubular 250. However, proppant and other solid particles greater than a threshold size are prevented by valve 227 and screen 222 from flowing into tubular 250. In the embodiment of FIGS. 2B and 2C, the flow rate of a fluid (such as fracturing fluid) flowing from tubular 250 through ports 223A and 226A into the surrounding wellbore and formation while valve 227 is in an open position is greater than the flow rate of a second fluid (such as produced oil) flowing from the surrounding wellbore and formation though port 223A into tubular 250 while valve 227 is in a closed position. More particularly, valve 227 reduces or restricts the second fluid from flowing though port 223A while valve 227 is in the closed position.

Figure 5:
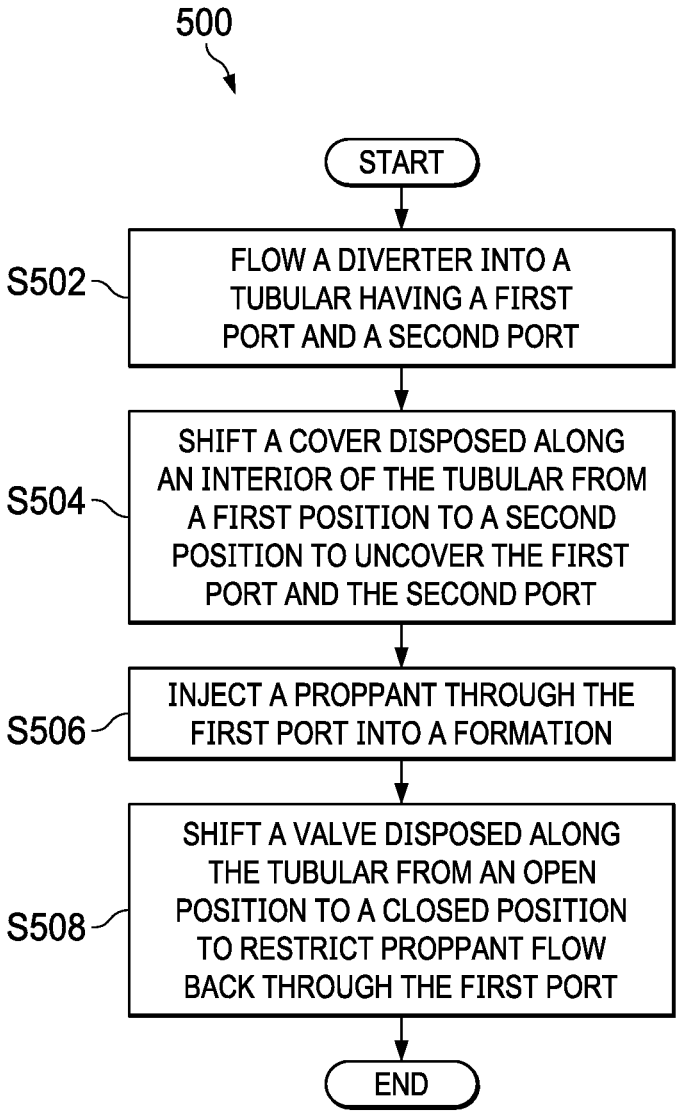
FIG. 5 is a flow chart of a process to reduce proppant flow back.

FIG. 5 is a flow chart of a process 500 to reduce proppant flow back. Although the operations in the process 500 are shown in a particular sequence, certain operations may be performed in different sequences or at the same time where feasible.

At block S502, a diverter flows into a tubular having a first port and a second port. At block S504, a cover disposed along an interior of the tubular is shifted from a first position to a second position to uncover the first port and the second port. Operations performed at blocks S502 and S504 are similar to operations performed at blocks S402, and S404, which are described in the paragraphs above. At block S506, a proppant is injected through the first port into a formation. In the embodiment of FIG. 2B, proppant 265 is injected through port 223A into the nearby wellbore and formation, such as into fracture 125A of FIG. 1 to enhance existing fractures or form new fractures of the formation. At block S508, after injecting the proppant, a valve disposed along the tubular shifts from an open position to a closed position to restrict proppant flow back through the first port. FIGS. 2B-2C, for example, illustrate shifting valve 227 from an open position illustrated in FIG. 2B to a closed position illustrated in FIG. 2C. In the embodiment of FIG. 2C, proppant 265 is prevented by valve 227 and screen 222 from flowing back through ports 223A and 226A into tubular 250, thereby restricting proppant flow back through ports 223A and 226A. However, hydrocarbon resources in fluid form are not restricted by screen 222, and flow from the surrounding formation through port 226A into tubular 250.

The above-disclosed embodiments have been presented for purposes of illustration and to enable one of ordinary skill in the art to practice the disclosure, but the disclosure is not intended to be exhaustive or limited to the forms disclosed. Many insubstantial modifications and variations will be apparent to those of ordinary skill in the art without departing from the scope and spirit of the disclosure. The scope of the claims is intended to broadly cover the disclosed embodiments and any such modification. Further, the following clauses represent additional embodiments of the disclosure and should be considered within the scope of the disclosure:

Clause 1, a downhole completion system, comprising: a tubular extending through a wellbore and having a first port and a second port; a cover disposed along an interior of the tubular and configured to cover the first port and the second port while the cover is in a first position and is configured to uncover the first port and the second port while the cover is in a second position; and a valve disposed along the tubular and configured to differentially restrict fluid flow through the first port during different well operations.

Clause 2, the downhole completion system of clause 1, further comprising a screen disposed along the second port and configured to filter particles greater than a threshold size from flowing through the second port.

Clause 3, the downhole completion system of clause 2, further comprising an inflow control device that is fluidly coupled to the screen and configured to filter a fluid before the fluid flows from the wellbore through the second port into the tubular.

Clause 4, downhole completion system of any of clauses 2 or 3, further comprising an autonomous inflow control device that is fluidly coupled to the screen and configured to filter a fluid before the fluid flows from the wellbore through the second port into the tubular.

Clause 5, the downhole completion system of any of clauses 1-4, wherein the valve is shiftable from an open position to a closed position to differentially restrict fluid flow through the first port.

Clause 6, the downhole completion system of clause 5, wherein the first port provides a first fluid flow path from the tubular to the wellbore while the valve is in the open position, wherein the second port provides a second fluid flow path from the tubular to the wellbore while the valve is in the open position, and wherein the second port provides a third fluid flow path from the wellbore to the tubular while the valve is in the closed position.

Clause 7, the downhole completion system of any of clauses 5 or 6, wherein the valve is configured to restrict fluid flow through the first port into the tubular while the valve is in the closed position.

Clause 8, the downhole completion system of any of clauses 5-7, further comprising a screen that is coupled to the valve and configured to filter particles greater than a threshold size from flowing through the first port while the valve is in the closed position.

Clause 9, the downhole completion system of any of clauses 5-8, wherein the valve is in the closed position while the cover is in the first position, wherein the valve shifts to the open position after the cover shifts to the second position, and wherein the valve shifts back to the closed position after completion of a first well operation of the different well operations.

Clause 10, the downhole completion system of any of clauses 1-9, wherein the cover is configured to shift from the first position to the second position in response to a diverter landing on the cover.

Clause 11, the downhole completion system of any of clauses 1-10, wherein the cover is configured to shift from the first position to the second position in response to receiving an electrical signal to shift from the first position to the second position.

Clause 12, the downhole completion system of any of clauses 1-11, further comprising an erosion resistant insert disposed along a wall of the first port.

Clause 13, the downhole completion system of any of clauses 1-12, wherein the valve is at least one of a check valve, a ball valve, and a one way valve.

Clause 14, a method to produce differential flow rate through a port during different well operations, the method comprising: flowing a diverter into a tubular having a first port and a second port; shifting a cover disposed along an interior of the tubular from a first position to a second position to uncover the first port and the second port; flowing a first fluid through the first port and the second port into a wellbore during a first well operation; shifting a valve disposed along the tubular from an open position to a closed position; and after shifting the valve to the closed position, flowing a second fluid from the wellbore through the second port into the tubular during a second well operation.

Clause 15, the method of clause 14, wherein the valve restricts fluid flow of the second fluid through the first port while the valve is in the closed position.

Clause 16, the method of clause 15, wherein shifting the cover comprises shifting the cover from the first position to the second position prior to commencement of a stimulating operation, and wherein shifting the valve comprises shifting the valve from the open position to the closed position prior to commencement of a production operation.

Clause 17, a method to reduce proppant flow back, the method comprising: flowing a diverter into a tubular having a first port and a second port; shifting a cover disposed along an interior of the tubular from a first position to a second position to uncover the first port and the second port; injecting a proppant through the first port into a formation; and after injecting the proppant, shifting a valve disposed along the tubular from an open position to a closed position to restrict proppant flow back through the first port.

Clause 18, the method of clause 17, further comprising flowing a fluid from the formation through a screen that covers the second port while the diverter is in the closed position.

Clause 19, the method of any of clauses 17 or 18, wherein the valve is shifted from the open position to the closed position prior to commencement of a production operation.

Clause 20, the method of any of clauses 17-19, further comprising performing a fracturing operation through the first port to facture the formation, wherein the valve is shifted from the open position to the closed position after performance of the fracturing operation.

As used herein, the singular forms "a", "an" and "the" are intended to include the plural forms as well, unless the context clearly indicates otherwise. It will be further understood that the terms "comprise" and/or "comprising," when used in this specification and/or the claims, specify the presence of stated features, steps, operations, elements, and/or components, but do not preclude the presence or addition of one or more other features, steps, operations, elements, components, and/or groups thereof. In addition, the steps and components described in the above embodiments and figures are merely illustrative and do not imply that any particular step or component is a requirement of a claimed embodiment.

Arrows indicating directions of fluid flow are illustrated for illustration purposes only. It is understood that fluids may flow in additional directions not shown in the Figures.

What is claimed is:

1. A downhole completion system, comprising:

a tubular extending through a wellbore and having a first port and a second port;

a cover disposed along an interior of the tubular and configured to cover the first port and the second port while the cover is in a first position and is configured to uncover the first port and the second port while the cover is in a second position; and a valve disposed along the tubular and configured to differentially restrict fluid flow through the first port based on different directions of fluid flow of the fluid flowing through the first port during different well operations.

2. The downhole completion system of claim 1, further comprising a screen disposed along the second port and configured to filter particles greater than a threshold size from flowing through the second port.

3. The downhole completion system of claim 2, further comprising an inflow control device that is fluidly coupled to the screen and configured to filter a fluid before the fluid flows from the wellbore through the second port into the tubular.

4. The downhole completion system of claim 2, further comprising an autonomous inflow control device that is fluidly coupled to the screen and configured to filter a fluid before the fluid flows from the wellbore through the second port into the tubular.

5. The downhole completion system of claim 1, wherein the valve is shiftable from an open position to a closed position to differentially restrict fluid flow through the first port.

6. The downhole completion system of claim 5, wherein the first port provides a first fluid flow path from the tubular to the wellbore while the valve is in the open position, wherein the second port provides a second fluid flow path from the tubular to the wellbore while the valve is in the open position, and wherein the second port provides a third fluid flow path from the wellbore to the tubular while the valve is in the closed position.

7. The downhole completion system of claim 5, wherein the valve is configured to restrict fluid flow through the first port into the tubular while the valve is in the closed position.

8. The downhole completion system of claim 5, further comprising a screen that is coupled to the valve and configured to filter particles greater than a threshold size from flowing through the first port while the valve is in the closed position.

9. The downhole completion system of claim 5, wherein the valve is in the closed position while the cover is in the first position, wherein the valve shifts to the open position after the cover shifts to the second position, and wherein the valve shifts back to the closed position after completion of a first well operation of the different well operations.

10. The downhole completion system of claim 1, wherein the cover is configured to shift from the first position to the second position in response to a diverter landing on the cover.

11. The downhole completion system of claim 1, wherein the cover is configured to shift from the first position to the second position in response to receiving an electrical signal to shift from the first position to the second position.

12. The downhole completion system of claim 1, further comprising an erosion resistant insert disposed along a wall of the first port.

13. The downhole completion system of claim 1, wherein the valve is at least one of a check valve, a ball valve, and a one way valve.

14. A method to produce differential flow rate through a port during different well operations, the method comprising:

flowing a diverter into a tubular having a first port and a second port;

shifting a cover disposed along an interior of the tubular from a first position to a second position to uncover the first port and the second port;

flowing a first fluid through the first port and the second port into a wellbore during a first well operation;

shifting a valve disposed along the tubular from an open position to a closed position; and after shifting the valve to the closed position, flowing a second fluid from the wellbore through the second port into the tubular during a second well operation.

15. The method of claim 14, wherein the valve restricts fluid flow of the second fluid through the first port while the valve is in the closed position.

16. The method of claim 15, wherein shifting the cover comprises shifting the cover from the first position to the second position prior to commencement of a stimulating operation, and wherein shifting the valve comprises shifting the valve from the open position to the closed position prior to commencement of a production operation.

17. A method to reduce proppant flow back, the method comprising:

flowing a diverter into a tubular having a first port and a second port;

shifting a cover disposed along an interior of the tubular from a first position to a second position to uncover the first port and the second port;

injecting a proppant through the first port into a formation; and after injecting the proppant, shifting a valve disposed along the tubular from an open position to a closed position to restrict proppant flow back through the first port, wherein the valve is configured to differentially restrict fluid flow through the first port based on different directions of fluid flow of the fluid flowing through the first port.

18. The method of claim 17, further comprising flowing a fluid from the formation through a screen that covers the second port while the valve is in the closed position.

19. The method of claim 17, wherein the valve is shifted from the open position to the closed position prior to commencement of a production operation.

20. The method of claim 17, further comprising performing a fracturing operation through the first port to facture the formation, wherein the valve is shifted from the open position to the closed position after performance of the fracturing operation.

* * * * *